United States Patent [19]

Numakami et al.

[11] Patent Number: 4,527,355

[45] Date of Patent: Jul. 9, 1985

[54] OPENING AND CLOSING TYPE LOUVER DEVICE

[75] Inventors: Hajime Numakami, Chigasaki; Hideyuki Kuroda, Kamakura, both of Japan

[73] Assignee: Zeon Kasei Co., Ltd., Tokyo, Japan

[21] Appl. No.: 469,522

[22] Filed: Feb. 24, 1983

[51] Int. Cl.[3] ..... E05F 17/00; E06B 7/086

[52] U.S. Cl. ..... 49/82; 49/90; 49/92; 49/275

[58] Field of Search ..... 49/90, 92, 74, 82, 87, 49/275; 98/121 A

[56] References Cited

U.S. PATENT DOCUMENTS

| | | | |
|---|---|---|---|
| 2,822,587 | 2/1958 | Hallock | 49/92 |
| 3,044,387 | 7/1962 | Hinden | 49/92 X |
| 3,718,081 | 2/1973 | Root | 49/82 X |
| 3,885,347 | 5/1975 | Adachi et al. | 49/92 |
| 4,099,346 | 7/1978 | Isono | 49/90 X |

*Primary Examiner*—Philip C. Kannan

*Attorney, Agent, or Firm*—Weingarten, Schurgin, Gagnebin & Hayes

[57] ABSTRACT

An opening and closing type louver device comprising a louver in which a number of blades are arranged in a row in a required spaced relation on rotating shafts within a frame. Each blade is opened and closed by a driving mechanism while maintaining their parallel relation.

2 Claims, 11 Drawing Figures

OPENING AND CLOSING TYPE LOUVER DEVICE

BACKGROUND OF THE INVENTION

1. Field of the Invention

The present invention relates to a construction of louver blades, a mounting construction of said blades and an opening and closing type louver device which can prevent slip of a ratchet as a driving mechanism to simply and accurately adjust engagement between the blades.

2. Description of Prior Art

The opening and closing type louver device is generally composed of a louver having a number of blades journaled in parallel on a frame and a driving mechanism for opening and closing the louver, wherein a common reciprocating rod mounted on driving arms supported on shafts of the blades is reciprocated through a connecting rod mounted on a ratchet, the blades are rotated and opened while maintaining the same relative position to admit the rays of the sun or the blades are closed to engage side edge plates of blades adjacent to each other. With this arrangement, the louvers may be used for roofs, sunshades, etc., and therefore, the louvers are widely used for the roof eaves, roofs for terraces, and others.

In the opening and closing louver device, the louver is freuently opened and closed, and thus, the blade is fitted in the hollow shaft, and the idle shaft and driving shaft, which are provided to open and close the blades, associated with the driving mechanism through the driving arm tend to wear. Therefore, the device poses a significant problem in that even if such a wear is insignificant, the idle shaft or driving shaft slips within the hollow shaft and as the result, the blades cannot be opened or closed.

In case of rain, the louver is closed to serve as a roof, and therefore, the louver needs to exclude rainwater or the like. When the louver is closed, side edges of adjacent blades are in engagement with each other with a gap. Despite the presence of a considerable engaging depth of the side edges, water sometimes enters through said engaging portion to produce a water leakage, which is a problem to be solved.

The ratchet is provided with an anti-reverse mechanism, and even if wind acts on the blades of the louver in a reversing direction of the ratchet, said anti-reverse mechanism overcomes the wind force to prevent flapping blades. However, an anti-slip mechanism of the ratchet is not particularly provided with respect to the forward rotating direction, and there is a problem that reliance is merely made on the frictional force between a feed pawl or an anti-reverse pawl and a curved surface of a gear of the ratchet.

There is a further problem that due to the frequent occurrence of working allowable errors in louver constituting members, mounting errors made when the device is installed at the site and the like, it is necessary to provide an adequate engaging state of blades while pushing the reciprocating rod rightwards or pulling it leftwards to rotate the blades, at the closed position of the opening and closing louver device after the latter has been installed, which requires extremely cumbersome operation and leads to a damage of the driving mechanism.

SUMMARY OF THE INVENTION

It is therefore a first object of the present invention to provide an opening and closing louver device which has solved the aforesaid problems with respect to conventional devices.

It is a further object of the present invention to provide an opening and closing louver device which is simple in execution and is provided with a blade plate construction which is free from possible slip even caused by an insignificant wear of the idle shaft and driving shaft and a mounting construction of a blade plate which produces no leakage of rain when the louver is closed.

It is another object of the present invention to provide an opening and closing louver device which is provided with a ratchet anti-slip means which can prevent the slip of the ratchet of the louver in a forward direction, and in which when the ratchet is driven, the anti-slip function is positively released so as not to impair the driving.

It is a still further object of the present invention to provide an opening and closing louver device provided with a construction in which the engagement between blades in the closed state of blades may be adjusted easily, accurately and adequately.

In view of these objects noted above, the present invention provides a device provided with a louver in which a number of blades are arranged in a line in a required spaced relation by rotating shafts within a frame, and blades are operated to be opened and closed by a driving mechanism while maintaining their parallel relation, wherein the blade and rotating shaft are integrally formed by forming a hollow shaft in a central portion of the blade plate into a polygon in section, forming an inserting portion of an idle shaft and a driving shaft, which are inserted into the hollow shaft, into a square pillar of the same sectional shape, providing fitting between a plurality of raised strips projected on corners of said square pillar portion, and providing fitting by contact between the raised strips, both sides of the shaft and the hollow shaft, to thereby provide a close coupling therebetween to prevent slip of the rotating shaft resulting from wear.

Further, an inclination angle of the rotating shaft to a horizontal surface is controlled within a given degree, and in the range of said angle, even a distance between surfaces of adjacent side plates in engagement with each other when the blades are closed is limited to a given range of dimentions to prevent leakage of water from the engaging portion.

In the present invention, a driving mechanism which operates to open and close a louver comprises a ratchet gearing secured to the side of a frame, a driving arm connected to a driving shaft of each blade, a reciprocating rod connected to said driving arm, and a length-adjustable connecting rod interposed between said reciprocating rod and said ratchet gearing, wherein the ratchet is easily connected to the reciprocating rod by the provision of the connecting rod, and a driving force produced by rotation of the ratchet is transmitted smoothly.

Furthermore, in the present invention, an anti-slip mechanism comprising a locking gear provided on the side of the ratchet, a rotatable slip stopper on the side of a base plate in engagement with said locking gear, and means for releasing said slip stopper from the locking gear by means of a driving lever is provided on a ratchet gearing which forms a part of said driving mechanism whereby the slip of the ratchet in a forward direction may be prevented to maintain the open state even if the external force is applied to the blades.

PREFERRED EMBODIMENT OF THE PRESENT INVENTION

Figure 1:
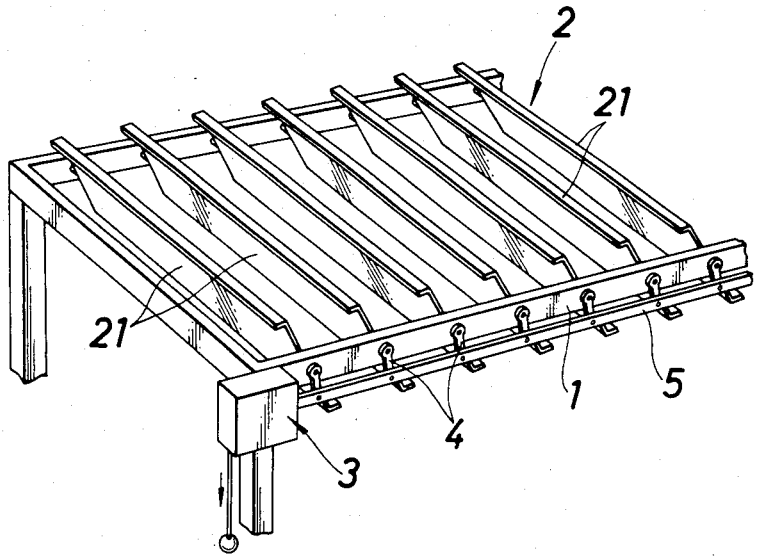
FIG. 1 is a perspective view of an opening and closing type louver device in accordance with the present invention.

Preferred embodiments of the present invention will now be described in detail with reference to the accompanying drawings.

In the drawings, reference numeral 1 designates a frame whose planar shape is rectangular. Reference numeral 2 designates an openable and closable louver provided internally of the frame 1. In the louver 2, a number of blades 21, 21 are pivotally mounted on the frame 1 so that the blades are arranged in a line in a required spaced relation. These blades 21, 21 are pivotally moved by a driving mechanism 3 while maintaining a parallel relation with one another.

Figure 2:
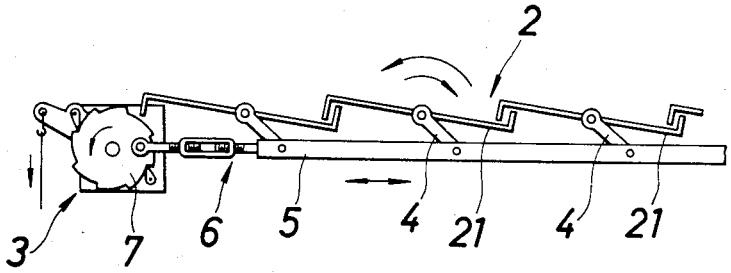
FIG. 2 is a partial side view showing the relative construction between a plurality of blades and a driving mechanism adapted to open and close the blades.

The driving mechanism 3 is composed, as shown in FIG. 2, of a ratchet gearing secured to the frame 1, driving arms 4 each secured at a required angle to one end of a rotating shaft of each of the blades 21, 21, a reciprocating rod 5 connected to free ends of these driving arms 4, 4, and a connecting rod 6 for connecting the reciprocating rod 5 with a ratchet 7.

Figure 3:
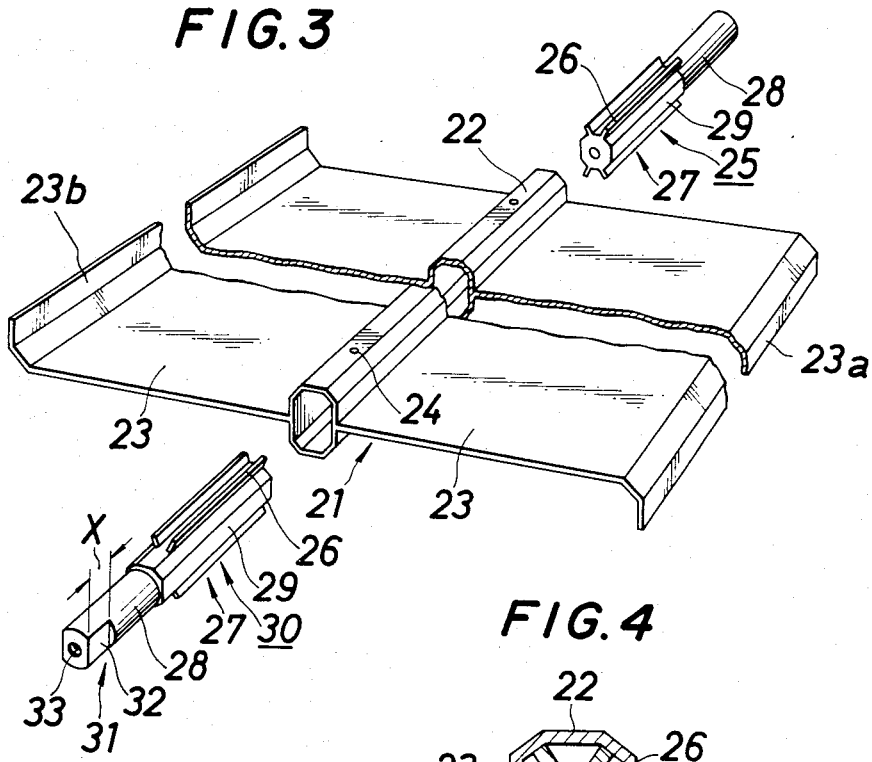
FIG. 3 is a perspective view of the blade and an idle shaft and a driving shaft.
Figure 4:
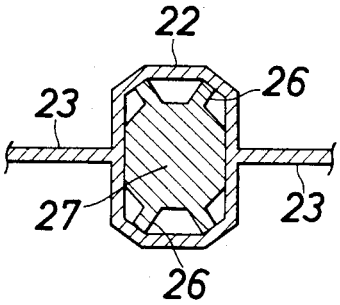
FIG. 4 is a longitudinally sectional side view of the blade.

FIGS. 3 and 4 illustrate the construction of the blade 21. The blade 21 is composed of an octagonal longitudinally extending hollow shaft 22 and blade members 23, 23 provided on both sides of the hollow shaft. Both ends of the blade member 23 parallel to the hollow shaft 22 are in the form of side edge plates 23*a*, 23*b* which are bent alternately up and down. The upper surface of the end of the shaft is provided with an idle shaft 25 and a hole 24 for mounting a small screw for securing the driving shaft 30, which will be described later. While the hollow shaft is octagonal in the illustrated embodiment, it should be noted that the shaft can be polygonal such as hexagon, square, etc. The blades 21 can be an integral body molded by extrusion of aluminium or synthetic resin. The hollow shaft 22 and the blade members 23 can be separately manufactured and assembled.

The idle shaft 25 is substantially a pillar of polygon cross-section typically a reular octagon in section and has square raised strips 26 at corners. The idle shaft comprises a shaft inserting portion 27 formed with a small tapped hole (not shown) for fixing the hollow shaft 22 and a cylindrical portion 28 fitted into the hole of the frame 1. The number and strength of the aforesaid raised strips are determined in consideration of the weight of the blades 21, the square construction of the hollow shaft 22 or the like. The shaft inserting portion 27 is constructed such that since the octagonal hollow shaft 22 is longitudinally extending octagonal, a side portion 29 of the square pillar and the raised strips 26 are in contact with and fitted in the side surface and inclined surface, respectively, of the inner wall of the hollow shaft. This construction was successful to prevent slip of the device due to wear. In order to prevent the idle shaft 25 from being accidentally slipped out of the hole of the frame 1, a ring-like stopper for example is fitted in the cylindrical portion, and for example, a bolt is screwed into the end of the shaft to prevent disengagement of the stopper ring.

Next, the driving shaft 30 comprises the shaft inserting portion 27 of the idle shaft 25, the shaft inserting portion 27 having a small tapped hole (not shown) of the same sectional shape, the cylindrical portion 28 pivots in the hole of the frame, and an arm mounting portion 31 formed with a notch 32 for the driving arm having an inclined cut surface, and the end of the shaft is formed with a tapped hole 33 for a fastening bolt (a small screw) used to mount the driving arm 4. After the blade plate 2 has been mounted on the frame 1, the driving arm 4 is inserted into the arm mounting portion, and the fastening bolt is screwed into the tapped hole 33 through a spring washer. Even if the fastening bolt to be inserted into the tapped hole 33 is not tightened accidentally, such untightening may be discovered easily because the driving arm 4 is disengaged by the opening and closing operation of the blade 21 or a play occurs in the blade 21 since the length X of the cut inclined surface of the notch 32 for the driving arm is substantially the same as the thickness of the driving arm 4. This advantageoulsy provides effects to prevent a damage of the blades 21 and an erroneous execution. These idle shaft 25 and driving shaft 30 can be manufactured separately or can be molded integrally depending on the shape of the blade body. In addition, the idle shaft 25 and driving shaft 30 are manufactured by extruding and molding aluminium or rigid synthetic resin material into the same sectional shape as the shaft inserting portion 27, cutting it to the required length, and thereafter applying mechanical working thereto. Therefore, it is possible to save materials, to simplify the manufacturing steps compared with prior arts and to greatly reduce the manufacturing cost without reducing the strength of the shaft.

Figure 5:
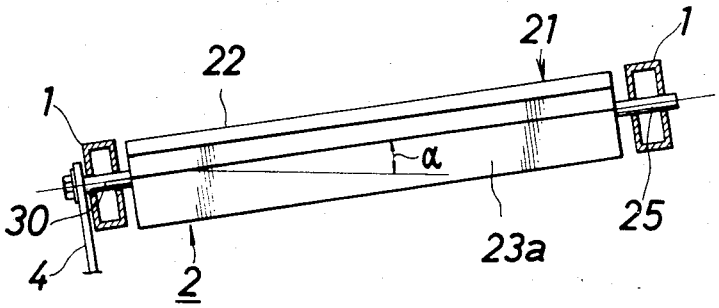
FIG. 5 is a longitudinal sectional front view of a frame and a blade.

FIG. 5 shows the mounting construction of the blade 21. An inclination angle $\alpha$ of the blade 21 to a horizontal surface of the rotating shaft is made above 0.7 degree, and in FIG. 6, the distance t between surfaces of side edge plates engaging each other when the blade 21 is closed is made above 0.5 mm.

Figure 6:
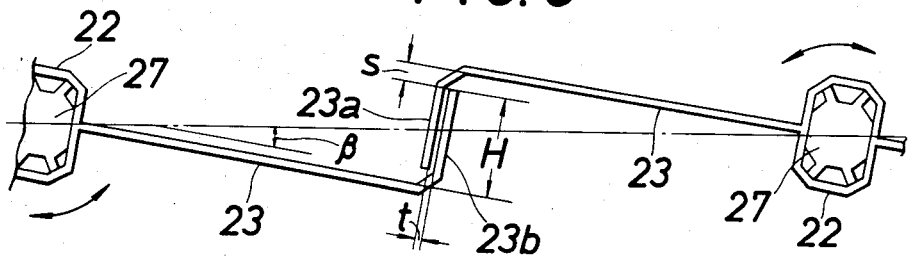
FIG. 6 is a side view for explanation of the engaging state of blades in the state shown in FIG. 5.

When rainwater falls on the closed blade surfaces of the louver 2 the water falls down along the inclination $\alpha$ of the blade plate members 23 relative to a horizontal surface and at a right angle to angle $\beta$ formed between the blade direction shown relative to the rotating shaft when the blade is closed, shown in FIG. 6. If the angle α is less than 0.7 degree, the pitch in a direction parallel to the rotating shaft decreases and thus, the flow of rainwater towards the side edge plate 23b which is in a relatively lateral direction increases whereby the rainwater is collected on a groove formed between the blade plate member 23a and the side edge plate 23b, resulting in a possible water leakage at an engaging portion between the side edge plates 23a and 23b. When the angle α is set to an excessively large value, the blades 21 are difficult to rotate, and therefore, the angle α is preferably below 45 degrees.

Also, when the spacing t between the engaged side edge plates 23a and 23b is below 0.5 mm, water is moved to the back of the blade due to the aforementioned capillarity, resulting in a possible occurrence of water leakage. Therefore, it is necessary to maintain the spacing of more than 0.5 mm. On the other hand, if the spacing t is too great, rebound of water tends to occur between the side edge plates 23a and 23b, and the aforementioned angle β increases to produce water leakage in the back of the blade. Therefore, the spacing t is preferably below 50 mm, more preferably, below 30 mm.

Figure 7:
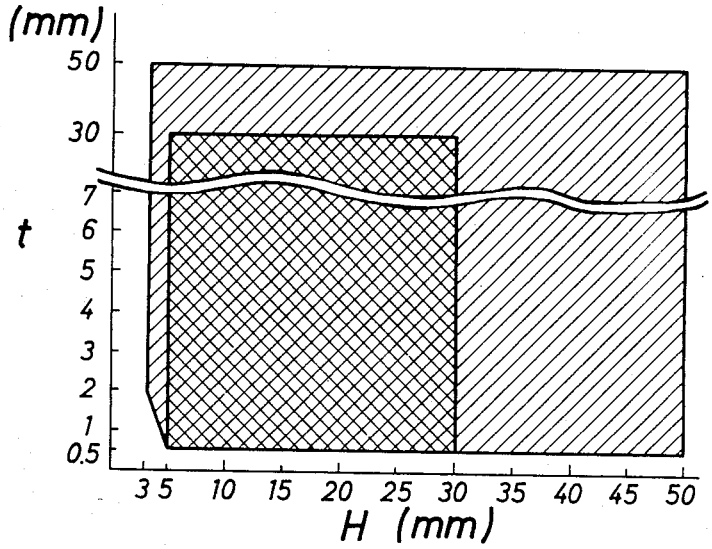
FIG. 7 is a view showing a preferable proportion between the height and spacing of side edge plates in the engagement of blades shown in FIG. 6.

This spacing t between the side edge plates 23a and 23b is affected by the height H of the side edge plate. If the height H is too small, a groove formed between the blade members 23 is too shallow, and therefore, even if the inclination angle α is made greater, it becomes difficult to adequately block rainwater, resulting in possible water leakage. Conversely, if the height is too great, the aforementioned angle β increases, as a consequence of which the inclination of the blade 21 increases so that the flow velocity of rainwater increases, water tends to leak and the function as a roof fails. In view of the foregoing, the value of height H is preferably from 3 mm to 50 mm, more preferably from 5 mm to 30 mm. As long as the range of the height H and the spacing t is in the above-described range, the value of a spacing s formed between the extreme ends of the side edge plates 23a, 23b and the opposed blade members 23 particularly poses no problem. A preferable range formed between the value of the height H and the value of the spacing t between the side edge plates is shown in FIG. 7. In FIG. 7, the preferable range is shown by the oblique lines, and a particularly preferable range is shown by the cross oblique lines.

FIG. 7 is a view in which the state of water leakage by (artificial) precipitation using the blade opening and closing type louver as shown in FIG. 1 is examined and the results obtained therefrom is shown. In this case, the hollow shaft portion 22 fitted in the shafts 25, 30, the blade plate members 23 and the side edge plates 23a, 23b were integrally molded by extrusion of aluminium, the length from one side edge plate 23a to the other side edge plate 23b was made 188 mm and the height H of the side edge plates 23a, 23b and the spacing t between the side edge plates were variously changed. These elements were mounted on the frame, and the test was conducted for five hours with the precipitation of 45 mm/hour. The result is given in the following Table 1.

TABLE 1

| Test No. | Value of H (mm) | Value of t (mm) | Angle α (deg.) | State of water leakage |
|---|---|---|---|---|
| 1 | 2 | 3.5 | 8 | Water leakage occurred after 20 min. or so |

TABLE 1-continued

| Test No. | Value of H (mm) | Value of t (mm) | Angle α (deg.) | State of water leakage |
|---|---|---|---|---|
| 2 | 4 | 3.5 | 8 | After termination of test, ooze of water appeared in the back of blade |
| 3 | 10 | 0.2 | 8 | Water leakage occurred after a lapse of one hour |
| 4 | 10 | 28 | 8 | No water leakage occurred |
| 5 | 23 | 3.5 | 8 | No water leakage occurred |
| 6 | 23 | 40 | 8 | After termination of test, ooze of water appeared in the back of blade |
| 7 | 45 | 28 | 8 | After termination of test, ooze of water appeared in the back of blade |
| 8 | 5 | 3.5 | 0.2 | Water leakage occurred after a lapse of 10 min. |
| 9 | 3 | 1 | 8 | Water leakage occurred after a lapse of 30 min. |

The blade 21 in Test No. 4 was used and various tests were conducted with the angle α in the range from 0.7 deg. to 45 deg. As a result, no water leakage occurred.

As is apparent from the above-described examples of test, it has been found that in the particularly preferable range shown in FIG. 7, no water leakage occurred, and even inthe preferable range, water leakage rarely occurred.

Figure 8:
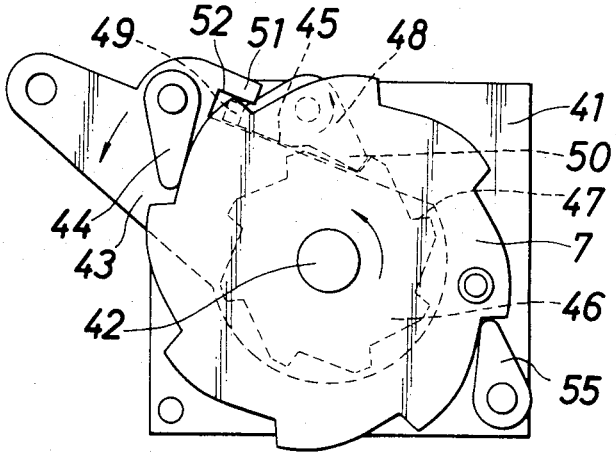
FIG. 8 is a side view of a ratchet gearing used for the driving mechanism in accordance with the present invention.
Figure 9:
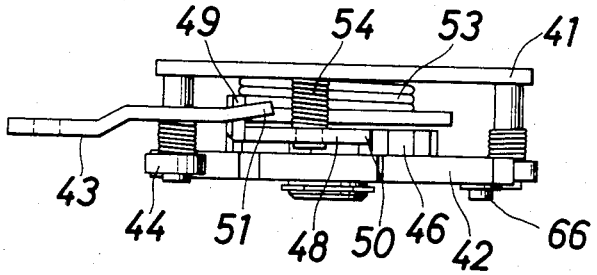
FIG. 9 is a plan view of the same.
Figure 10:
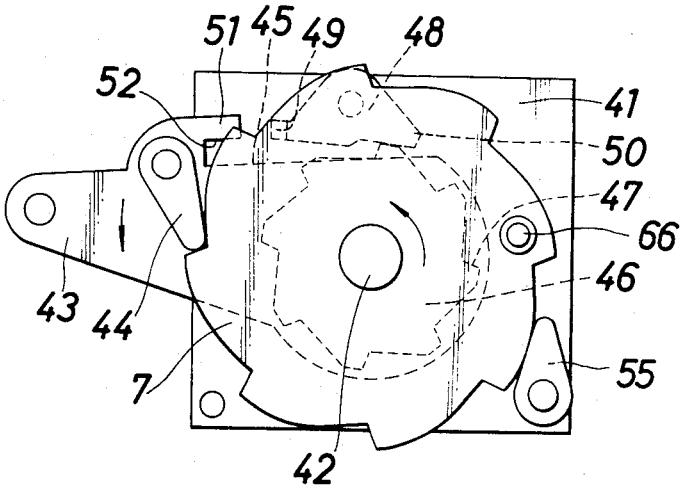
FIG. 10 is a side view showing the moving state of the ratchet.

FIGS. 8 to 10 show a ratchet gearing of the driving mechanism 3. FIG. 8 is a front view when a driving lever is returned, FIG. 9 is a plan view of the same, and FIG. 10 is a front view at a position halfway of the driving. A ratchet 7 of the ratchet gearing is integrally provided at the side thereof with a small diameter locking gear 46 on a comxon shaft 42. This locking gear 46 has the same number of teeth as that of the ratchet 7, and the teeth thereof are arranged opposedly each other. The ratchet 7 and the locking gear 46 can be formed integrally or they can be molded separately and joined in required position. A slip stopper 48 is pivotally mounted on a base plate 41, the slip stopper 48 having its rear end bended to form a stopper lever 49 and having a front end which serves as a stopper pawl 50 in engagement with the locking gear 46. A driving lever 43 is coaxial with the ratchet 7 and the ratchet is rotated by a feed pawl 44. The driving lever 43 has a forked projection 51 provided thereon.

In the aforementioned ratchet gearing, when the driving lever 43 is returned to its original position by means of a return spring 54 after the driving lever 43 has been fully drawn, the stopper lever 49 comes into contact with an upper edge 45 of the driving lever 43, and as the driving lever 43 rotates clockwise, the upper edge 45 is slidably moved whereby the driving lever 43 is returned to the top dead center and the stopper pawl 50 comes into engagement with a tooth surface of the locking gear 46. Accordingly, the ratchet 7 integral with the locking gear 46 is impaired in slip in a forward direction since the locking gear 46 is impaired in rotation in a forward direction by the slip stopper 48.

Next, when the driving lever 43 is drawn downwardly to rotate the ratchet 7, a lower edge 52 of the forked projection 51 provided on the driving lever 43 slidably moves while pressing the stopper lever 49 and the slip stopper 48 is forcibly rotated counterclockwise to positively release the engagement between the stopper pawl 50 and the tooth surface 47 of the locking gear 46.

After release of said engagement, the feed pawl 44 comes into contact with the tooth surface of the ratchet 7 to assume the state that driving can start. To provide such operation, a clearance is formed between the feed pawl 44 and the tooth surface. Even if frictional resistance between the stopper pawl 50 and the locking gear 46 is increased by the action of external force, the slip stopper 48 may be rotated upon the principle of a lever by the traction of the driving lever, and therefore, there is no possibility that the engagement between the slip stopper 48 and the locking gear 46 is not released. A stopper coiled spring 54 encircling the rotating shaft of the slip stopper 48 is mounted between the slip stopper 48 and the base plate 41 whereby after the release of engagement of the slip stopper, the slip stopper remains its position after it has been rotared counterclockwise and when the driving lever 43 is returned to its original position, the slip stopper 48 and the stopper lever 49 is positively brought into contact with the upper edge 45 of the driving lever 43. Reference numeral 55 shows the anti-reverse pawl.

With the above-described arrangement, as the driving lever returns to its original position after the traction thereof, the slip stopper may be positively brought into engagement with the locking gear. The ratchet and thus the locking gear integral therewith is subjected to powerful torque in a forward direction by the action of an external force to increase the frictional resistance between the stopper pawl and the tooth surface of the locking gear, and despite this, driving can be made overcoming said resistance and no possible failure resulting therefrom occurs.

Figure 11:
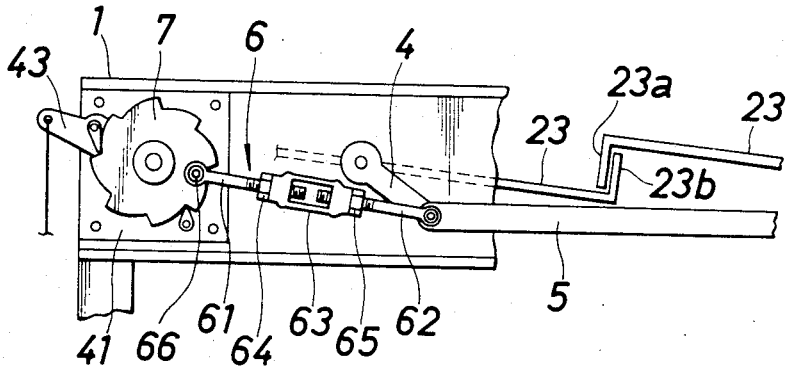
FIG. 11 is a side view of a driving mechanism.

FIG. 11 shows the driving mechanism 3 operated by the aforesaid ratchet gearing. In this driving mechanism 3, an idea in which the length of a connecting rod is constant is corrected, and a connecting rod 6 provided with a turnbuckle 63 is used to push or pull a reciprocating rod 5 which is expansible in length, thereby providing positive opening and closing of the louver 2.

In the connecting rod 6, one end of a left half of a rod member 61 is pivotally mounted on a crank pin 66 of the ratchet 7, and the other end thereof is formed with a left-hand screw, for example, and is screwed into a left side portion of the turnbuckle 63. One end of a right half of a rod member 62 is pivotally mounted on the end of the reciprocating rod 5, and the other end thereof is formed with a right-hand screw reversely to the former and is screwed into a right side portion of an outer cylinder 63 to form a connecting rod 6 provided with a connecting rod like a turnbuckle. Lock unts 64, 65 are screwed into both sides of the outer cylinder 63. To adjust the engaging state between the blades, left and right lock nuts 64 and 65 are loosened and the outer cylinder 63 is moved back and forth while watching the engaging state of the blades 21, 21 when the louver 2 is closed, then the reciprocating rod 5 is moved laterally and accordingly the bended end edge of the blade member 23 moves towards and away from the flat plate surface of the adjacent blade member 23, at this time of which the outer cylinder 63 is stopped at the optimal position and the lock nuts 64 and 65 are tightened. Alternatively, in the connecting rod 6 provided with a turnbuckle, only one out of the left half rod member 61 and right half rod member 65 is screwed into the outer cylinder 63, and the other member is rotatably mounted coaxial with the outer cylinder 63 to change only the length of one rod member for adjustment.

What is claimed is:

1. An opening and closing type louver device comprising a louver in which a number of blades are arranged in a row in a required spaced relation on rotating shafts within a frame, each blade being opened and closed by a driving mechanism while maintaining their parallel relation, said device comprising a blade in which blade members provided with alternate upper and lower engaging side edge plates at ends thereof parallel to a hollow shaft are integrally provided on opposite sides of the hollow shaft having a polygon in section, a rotating shaft comprising two members, one for an idle shaft having pillar portions of the same sectional shape fittable in said hollow shaft and the other for a driving shaft, each of said pillar portions having a polygon cross-section projectingly provided with a plurality of raised strips in contact with inner corners of the hollow shaft, a driving arm mounted on a free end of the driving shaft of each of said blades and a reciprocating rod connected to said driving arms, a ratchet gearing secured to the side of said frame, and a length-adjustable connecting rod interposed between said ratchet and said reciprocating rod to transmit rotation of the ratchet to the reciprocating rod, wherein said ratchet gearing comprises a shaft of a base plate secured to the frame side, a driving lever having a ratchet pivotally mounted on said shaft and a ratchet feed pawl, and a spring member encircling the shaft for always biasing said driving lever, and an anti-slip mechanism is provided which comprises a small diameter gear having the same number of teeth as that of said ratchet and integrally provided on the side of the ratchet with said teeth directed reversely to the ratchet teeth, stopper pawl rotatably mounted on required portions of said base plate to engage said locking gear, and a stopper level in engagement with a projection provided projectingly on the driving level to release engagement between the locking gear and the stopper pawl as said driving lever moves.

2. An opening and closing type louver device comprising a louver in which a number of blades are arranged in a row in a required spaced relation on rotating shafts within a frame, each blade being opened and closed by a driving mechanism while maintaining their parallel relation, said device comprising a blade in which blade members provided with alternate upper and lower engaging side edge plates at ends thereof parallel to a hollow shaft are integrally provided on opposite sides of the hollow shaft havng a polygon in section, a rotating shaft comprising two members, one for an idle shaft having pillar portions of the same sectional shape fittable in said hollow shaft and the other for a driving shaft, each of said pillar portions having a polygon cross-section projectingly provided with a plurality of raised strips in contact with inner corners of the hollow shaft, a driving arm mounted on a free end of the driving shaft of each of said blades and a reciprocating rod connected to said driving arms, a ratchet gearing secured to the side of said frame, and a length-adjustable connecting rod interposed between said ratchet and said reciprocating rod to transmit rotation of the ratchet to the reciprocating rod, wherein said connecting rod comprises a rod member connected to the side of the ratchet and a rod member connected to the side of the reciprocating rod, opposed ends of said both rod members are formed into screw shafts, and a turnbuckle is threaded about said screw shaft for adjustment of the length.

* * * * *